US005611106A

United States Patent [19]

Wulff

[11] Patent Number: 5,611,106

[45] Date of Patent: Mar. 18, 1997

[54] CARPET MAINTAINER

[75] Inventor: Richard F. Wulff, Maple Plain, Minn.

[73] Assignee: Castex Incorporated, Holland, Mich.

[21] Appl. No.: 588,623

[22] Filed: Jan. 19, 1996

[51] Int. Cl.[6] ..... A47L 5/05

[52] U.S. Cl. ..... 15/320; 15/347; 15/349

[58] Field of Search ..... 15/320, 347, 349

[56] References Cited

U.S. PATENT DOCUMENTS

| | | | |
|---|---|---|---|
| 1,759,881 | 5/1930 | Bentley | 15/384 |
| 3,879,789 | 4/1975 | Kasper | 15/320 X |
| 4,369,544 | 1/1983 | Parisi | 15/320 |
| 5,018,240 | 5/1991 | Holman | 15/384 X |
| 5,093,955 | 3/1992 | Blehert et al. | 15/349 X |

*Primary Examiner*—Chris K. Moore

*Attorney, Agent, or Firm*—Price, Heneveld, Cooper, DeWitt and Litton

[57] ABSTRACT

A carpet maintainer comprising a mobile support having power drive for advancing the support over an underlying carpet surface, a housing on the support, a cleaning solvent vessel on the support, a discharge spray bar at the support underside for discharging cleaning solvent from the vessel onto an underlying carpet surface, a pair of powered, counter-rotational, elongated brushes at the support underside, adjacent each other, and transverse to the support, the spray bar being forward of the brushes for ejecting cleaning solution on the carpet followed by brush scrubbing and pile pick-up of the carpet, a debris hopper, a suction fan in the housing, an air and debris conducting conduit extending from the hopper to the suction fan, and a collector bag between the hopper and suction fan so that dirt and debris swept up by the brushes is deposited in the hopper or drawn by the fan into the collector bag.

10 Claims, 3 Drawing Sheets

CARPET MAINTAINER

BACKGROUND OF THE INVENTION

This invention relates to a floor maintenance machine especially for carpeted floors of commercial buildings such as office buildings, hospitals, airport terminals, schools, nursing homes and the like, and particularly to a unique carpet maintainer that picks up debris and dust, lifts carpet pile in two directions, cleans carpet pile tips with a cleaning solution, and performs these processes with one rapid pass.

Conventional commercial carpet care equipment includes vacuum cleaners for pickup of dust and debris, typically used by frequently, e.g., daily, passing over carpet surfaces, and rotating brush units to pick up carpet pile. These units cannot keep the carpet from becoming soiled and tramped down over a period of time. Therefore, bonnet cleaners are then necessary to wet scrub the carpet. Bonnet cleaning is slow and disruptive of normal use activities in the area of the cleaning operation. As is known, bonnet cleaning is the process of placing a bonnet or a scrubbing pad onto a disc-type floor machine to clean the surface, but only the surface, of the carpet. Moreover, these multiple pieces of equipment must be kept, stored and maintained.

It would be advantageous to be able to constantly maintain carpet in excellent, cleaned, aesthetic condition with minimal time required and minimal disruption of usage of the area. This would be doubly advantageous if it could prevent the carpet from gradually becoming more dirty and unsightly prior to the periodic bonnet cleaning operation.

SUMMARY OF THE INVENTION

Therefore, an object of this invention is to provide a floor maintainer capable of maintaining carpet constantly in excellent cleaned and aesthetically appealing condition, yet doing so in a relatively short equipment usage time, at frequent intervals such as daily or on alternate days or the like. Hence, carpet in commercial buildings, airports, etc. can be maintained in top condition without the necessity of periodic bonnet cleaning and without having to purchase, store and maintain the usual multiple pieces of cleaning equipment.

The carpet maintainer of this invention is capable of performing several functions with one relatively rapid pass over the carpet surface, to sweep it of debris and dust, lift the carpet pile from two opposite directions, clean the carpet, especially the tuft tips, with a cleaning solution, to thereby basically replace the multiple of conventional cleaning devices and functions normally necessary. Optionally, a second pass with the maintainer will remove remaining crystals of combined dirt and cleaning solution.

The novel carpet maintainer has a cleaning solvent spray bar forwardly of a pair of adjacent, counter rotating, transverse brushes that remove dust and debris and transfer it into a hopper or via a suction fan to a collector bag, pick up crushed carpet pile from two opposite directions, and scrub the carpet tuft tips. By readily maintaining the carpet on a steady basis, excessive soil, wear and loss of appeal can be avoided.

These and other objects, advantages and features of the invention will become apparent from a study of the following specification in conjunction with the drawings.

DESCRIPTION OF THE PREFERRED EMBODIMENT

Figure 2:
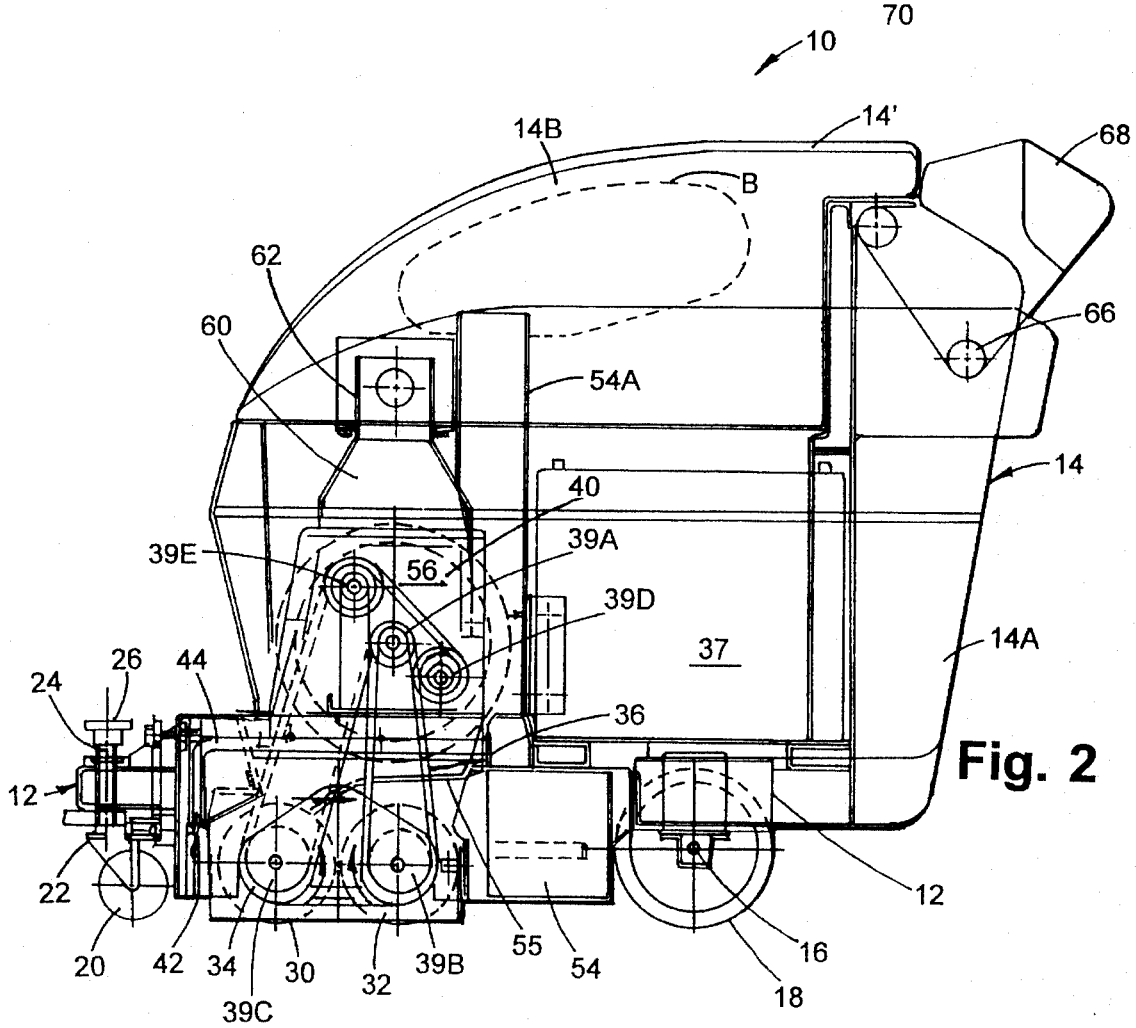
FIG. 2 is a side elevational, partially sectioned view of the maintainer.
Figure 4:
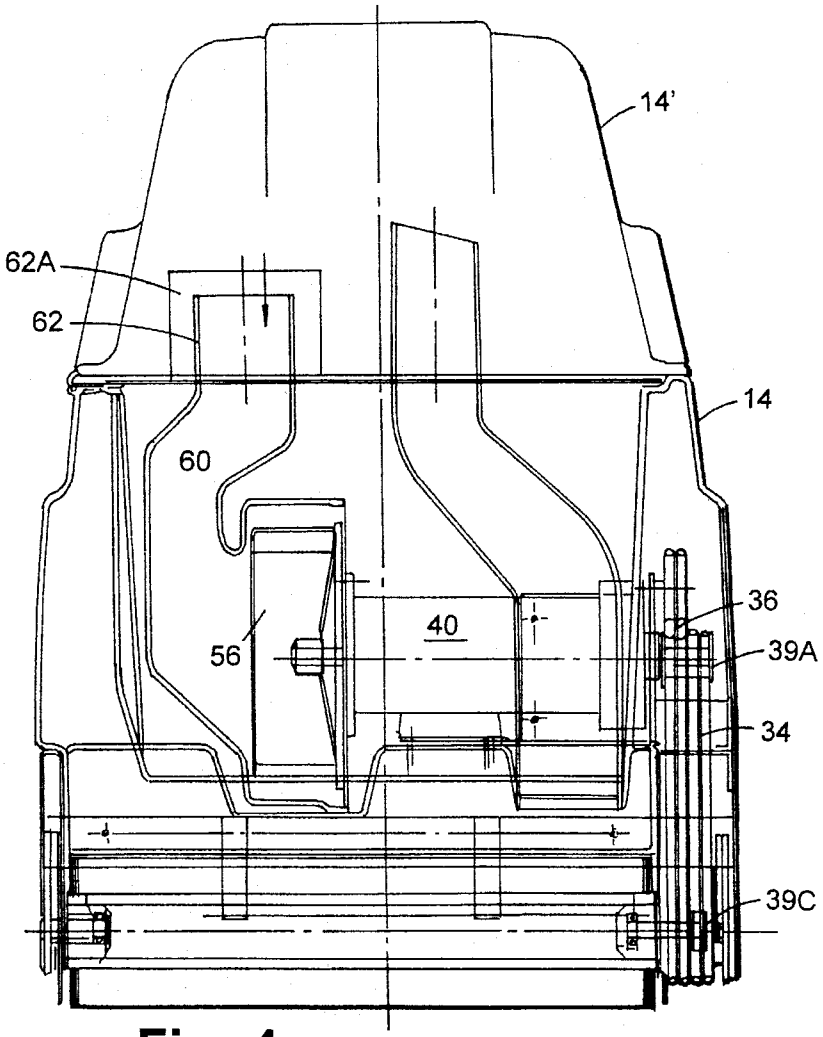
FIG. 4 is a front elevational view, partially sectioned, of the maintainer.

Referring now specifically to the drawings, the novel floor carpet maintainer 10 there depicted is a walk-behind model which has a support framework 12 encompassed by a housing 14 and mounted on a rear axle 16 and rear wheels 18 as well as a central front wheel 20 on a vertically adjustable bracket 22. The unit could alternatively be a rider model, e.g., such as the ride-behind type. Front wheel vertical adjustment is shown to be by means of a vertical screw shaft 24 and its control knob 26 on the upper end of the shaft, for making relative adjustment between front idler wheel 20 and support framework 12. Between rear wheels 18 and front idler wheel 20 is a pair of elongated, transverse brushes 30 and 32 which have their peripheries adjacent each other. These brushes rotate in opposite directions so that the immediately adjacent bristle ends of the two brushes move upwardly together as indicated by the arrows in FIG. 2. These brushes are driven by endless belts 34 and 36 around pulleys 39 A–E from an electrical motor 40 powered by storage batteries 37 supported by the frame structure. Conceivably, it could be powered by electricity from a conventional electrical wall outlet (not shown).

Adjacent the brushes, and here shown to be to the rear thereof, is a hopper 54 extending the width of the brushes. A deflector in the form of a scroll or panel 55 extends from above the common area between the brushes toward and over the hopper, to deflect/direct dirt, dust and debris into the hopper. The heavier debris stays in the hopper. The dust and light dirt is drawn into a disposable bag, as described hereinafter.

Figure 3:
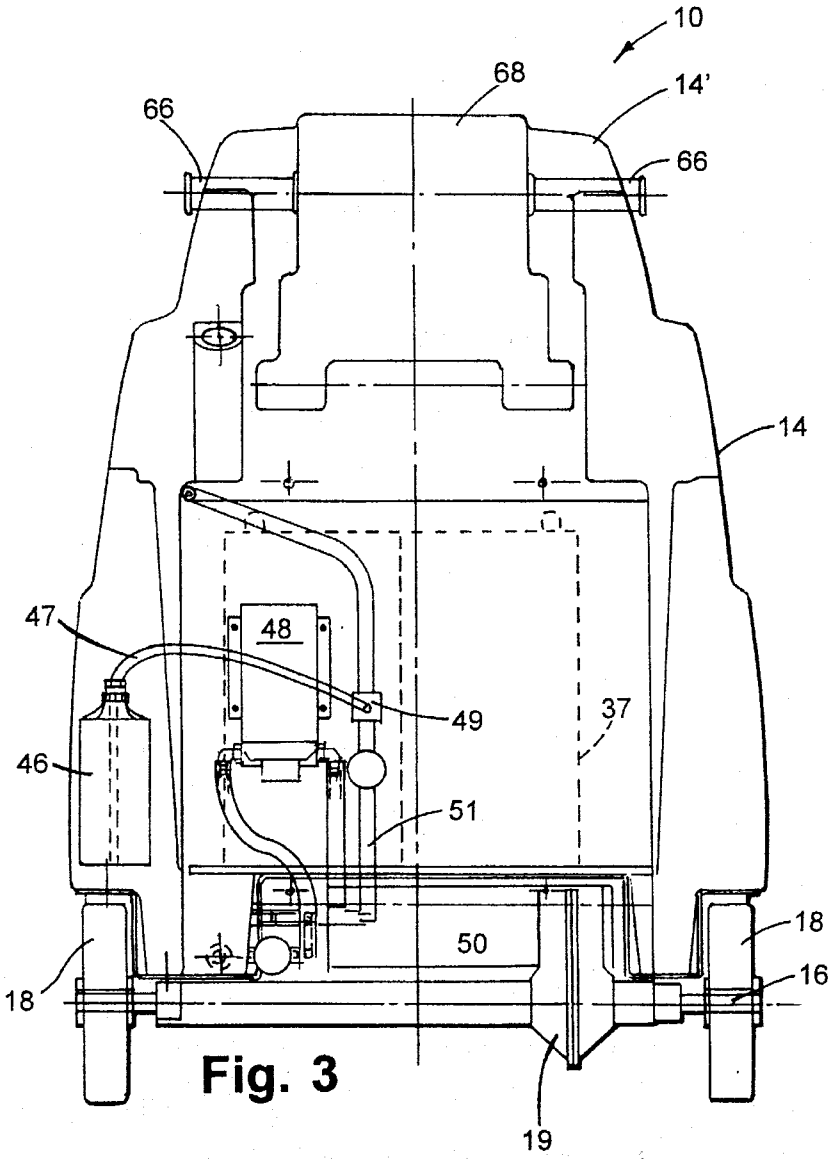
FIG. 3 is a rear elevational view of the maintainer.
Figure 5:
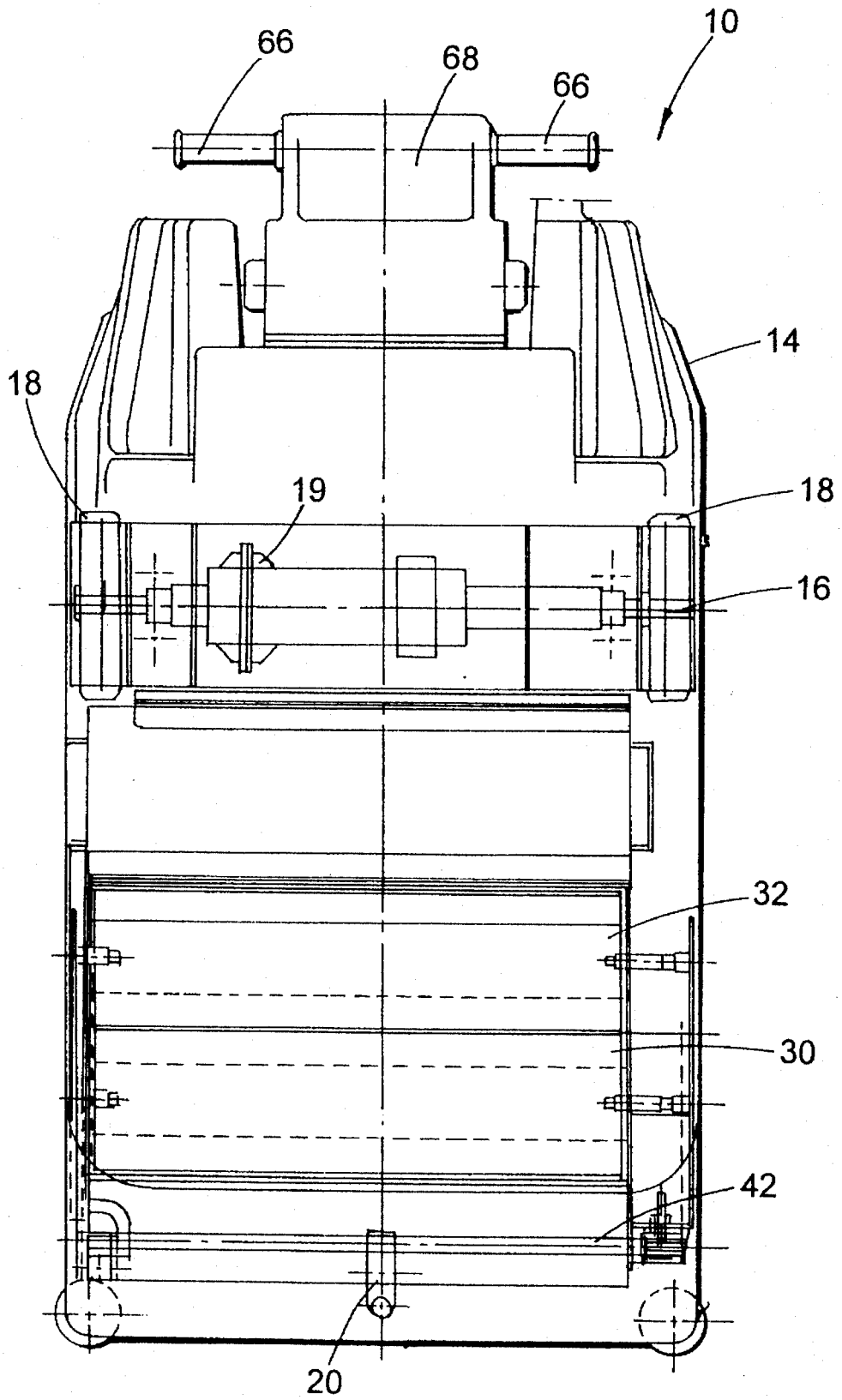
FIG. 5 is a bottom plan view of the maintainer.

Forwardly of the two powered transverse brushes is a transversely elongated spray bar 42 supplied with liquid cleaning solvent by conduit 44 from a cleaning solvent tank 14A mounted on support 12 in housing 14. A separate small pump (FIG. 3) and pump driving motor 48 am provided to propel cleaning solvent from tank 14A to spray bar 42. Normally, the cleaning solvent is water based. Preferably, the water has added reagents of known type to attract and coact with dirt to solidify into crystals so as to be subsequently readily brushed up out of the carpet. The added reagents can be manually added to the water, or may be injected as by being drawn from a bottle 46 (FIG. 3) through a robe 47 by an ejector 49, e.g., a venturi, into the main tube 51 leading to the spray bar. An air flow conduit 54A extends upwardly frown the hopper to a removable bag B attached to the outlet of air flow conduit 54A. This removable bag is beneath the cover 14' of housing 14. Cover 14' can be opened for ready access to this compartment space 14B and replacement of a dirty bag. A powered suction fan 56 has its inlet in the compartment space to draw dust and dirt laden crystals from the hopper 54, and hence from the carpet, into the removable bag. A filter 62A on the inlet nozzle 62 to suction housing 60 further cleans the moving air, if necessary, prior to air discharge.

Figure 1:
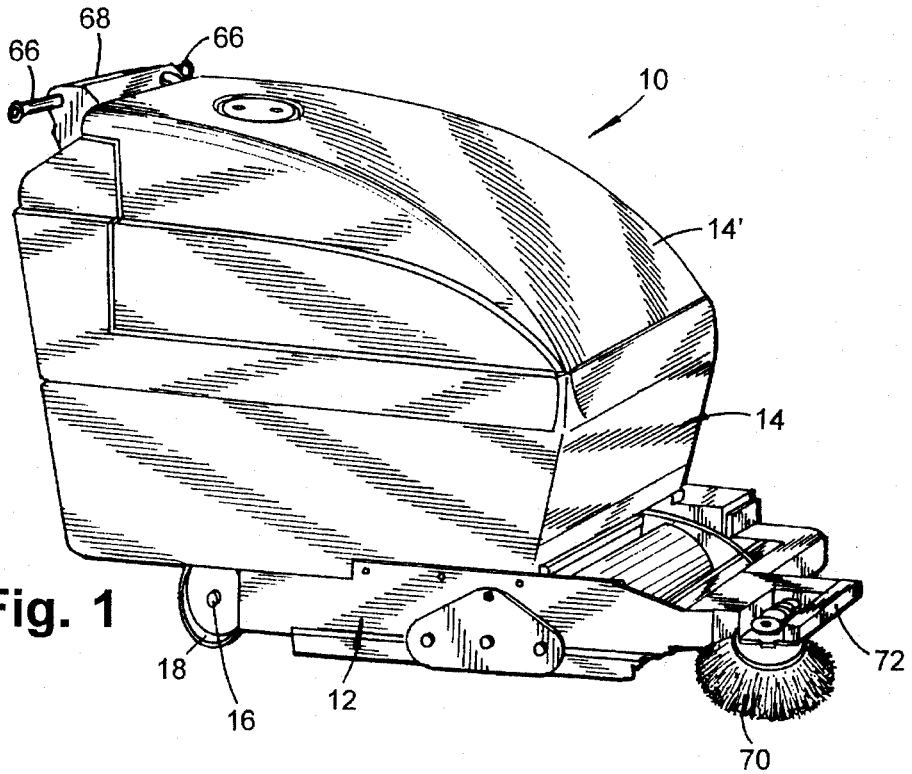
FIG. 1 is a perspective view of the novel floor carpet maintainer.

At the rear of this carpet maintainer unit is a pair of hand hold grips 66 (FIG. 1) and an instrumentation and control panel 68 to allow the operator of the machine to activate and monitor the various components. Rear wheels 18 are preferably power driven by motor 50, as through a differential 19 (FIG. 3) to propel the unit in forward or reverse direction.

The novel apparatus is primarily for maintaining carpet, but could also be used for hard surface floors, as will be apparent from the above and following description. It primarily has three functions which are performed with a single pass, namely sweep the surface of debris, lift carpet pile from two opposite directions, and wet solvent clean the surface of the carpet, particularly the carpet tuft tips. The maintainer can replace bonnet cleaning. If desired, the novel apparatus can be employed to sweep the carpet surface of debris and dust and lift the carpet pile, or perform these two functions in combination with wet cleaning. Optimally, the maintainer can be utilized daily with no solvent, e.g., at about 3 mph speed, and then once a week or so perform all three functions at a slower speed, e.g., 1½ mph or so. The equipment can be a two-speed apparatus or a variable speed apparatus controlled, for example, by a control board, a rheostat or the like. It has been found that the combination of the water solution plus the use of dual power brushes for sweeping and lifting carpet pile and cleaning the tips of the carpet function very effectively for maintaining the floor surface. The pile is actually lifted in two directions for optimum aesthetic appearance. This type of cleaning activity can eliminate the customary constant vacuuming with a vacuum machine and periodic bonnet cleaning and extraction of the carpet. The disposable filter bag B can be disposed of and replaced at the end of every day or week, as necessary.

Preferably, there is also a conventional removable side brush 70 which can pivot up out of the way when not needed. Specifically, side brush 70 is powered by the same motor to rotate it, and is on a frame piece 72 which holds the side brush in a laterally sweeping position for cleaning the corner area between the wall and the floor or beneath cabinets and the like, but is pivotable upwardly to lift the side brash out of action.

Conceivably those skilled in this field may make variations of the preferred embodiment set forth and described as exemplary of the invention. The invention is not intended to be limited to this specific embodiment, but only by the scope of the appended claims and the equivalent structures to those defined therein.

The embodiments of the invention in which an exclusive property or privilege is claimed are defined as follows:

1. A carpet maintainer comprising:

a mobile support having power drive means for advancing said support over an underlying carpet surface, and having an underside, a forward end and a rearward end;

a housing on said support;

a cleaning solvent vessel supported by said support;

a discharge spray bar at said support underside and associated with said vessel for discharging cleaning solvent from said vessel onto an underlying carpet surface;

a pair of powered, counter-rotational, elongated brushes at said underside, adjacent each other, and transverse to said support;

said spray bar being forward of said brushes for ejecting cleaning solution on a carpet followed by brush scrubbing and carpet pile tip pick-up;

a hopper adjacent said brushes to retain heavier debris;

a suction fan in said housing;

an air and dirt conducting conduit extending from said hopper toward said suction fan; and means for mounting a collector bag between said hopper and said suction fan so that dirt and dust swept up by said brushes can be deposited into said hopper or drawn by said fan into said collector bag.

2. The carpet maintainer in claim 1 including a motor, and a drive connection from said motor to both said brushes.

3. The carpet maintainer in claim 2 wherein said drive connection comprises endless belts and guide pulleys.

4. The carpet maintainer in claim 2 including electric storage batteries for said power drive means, said brushes and said pump.

5. The carpet maintainer in claim 1 including a powered pump, and a conduit between said pump and said ejector for forcing cleaning solvent to and out of said spray bar onto the carpet.

6. The carpet maintainer in claim 1 including an edge brush along one side of said carpet maintainer.

7. The carpet maintainer in claim 1 including a deflector above said brushes and toward said hopper to deflect debris, picked up by said brushes, into said hopper.

8. A floor maintainer comprising:

a mobile support having power drive means for advancing said support over an underlying floor surface, and having an underside, a forward end and a rearward end;

a housing on said support;

a cleaning solvent vessel on said support;

a discharge spray bar at said support underside and associated with said vessel for discharging cleaning solvent from said vessel onto an underlying floor surface;

a pair of powered, counter-rotational, elongated brushes at said underside, adjacent each other, and transverse to said support;

said spray bar being forward of said brushes for ejecting cleaning solution on the floor followed by brush scrubbing of the floor;

a hopper adjacent said brushes to retain heavier debris;

a suction fan in said housing;

an air and debris conducting conduit extending from said hopper toward said suction fan, and means for mounting a collector bag between said hopper and said suction fan whereby dirt swept up by said brushes is deposited in said hopper or drawn by said fan into said collector bag.

9. The floor maintainer in claim 8 including a motor, and a drive connection from said motor to both said brushes.

10. The floor maintainer in claim 8 including a deflector above said brushes and toward said hopper, to deflect debris picked up by said brushes into said hopper.

* * * * *

UNITED STATES PATENT AND TRADEMARK OFFICE

CERTIFICATE OF CORRECTION

PATENT NO. : 5,611,106
DATED : March 18, 1997
INVENTOR(S) : Richard F. Wulff

It is certified that error appears in the above-indentified patent and that said Letters Patent is hereby corrected as shown below:

Column 2, line 44;

"am" should be --are--.

Column 2, line 52;

"robe" should be --tube--.

Column 2, line 54;

"frown" should be --from--.

Column 3, line 39;

"brash" should be --brush--.

Signed and Sealed this

Fifth Day of August, 1997

Bruce Lehman

*Attest:*

BRUCE LEHMAN

*Attesting Officer*

*Commissioner of Patents and Trademarks*